US005432987A

United States Patent [19]

Schroth

[11] Patent Number: 5,432,987

[45] Date of Patent: Jul. 18, 1995

[54] CENTRAL LOCK FOR MULTI-POINT SAFETY BELTS

[75] Inventor: Carl-Jürgen Schroth, Soest, Germany

[73] Assignee: Carl F. Schroth GmbH, Arnsberg, Germany

[21] Appl. No.: 163,845

[22] Filed: Dec. 7, 1993

[30] Foreign Application Priority Data

Jan. 20, 1993 [DE] Germany ..... 43 01 403.8

[51] Int. Cl.[6] ..... A44B 11/00

[52] U.S. Cl. ..... 24/632; 24/573.5; 24/635

[58] Field of Search ..... 24/632, 635, 642, 573.5

[56] References Cited

U.S. PATENT DOCUMENTS

| | | | |
|---|---|---|---|
| 2,668,997 | 2/1954 | Irvin et al. | 24/632 |
| 3,106,004 | 10/1963 | Davis | 24/632 |
| 3,510,921 | 5/1970 | Gillmore | 24/632 |
| 3,534,448 | 10/1970 | Hughes | 24/573.5 |
| 3,639,948 | 2/1972 | Sherman | 24/632 |

FOREIGN PATENT DOCUMENTS

| | | | |
|---|---|---|---|
| 0656977 | 9/1951 | United Kingdom | 24/632 |

*Primary Examiner*—Victor N. Sakran
*Attorney, Agent, or Firm*—Friedrich Kueffner

[57] ABSTRACT

A central lock for multi-point safety belts or safety harnesses includes a housing with several insertion openings distributed over the circumference of the housing. Tongues connected to the belts can be inserted into the insertion openings. A holding plate for holding bolts interacting with the tongues is fixed in the housing. A rotatable release member mounted outside of the housing is provided for axially displacing a release plate against the force of a restoring spring. A mechanism is arranged between the release member and the release plate for transforming the rotary movement of the release member into an axial displacement of the release plate. The mechanism is formed by at least one tilting member arranged between the release member and the release plate which is located on the side of the holding plate facing away from the release member.

25 Claims, 7 Drawing Sheets

CENTRAL LOCK FOR MULTI-POINT SAFETY BELTS

BACKGROUND OF THE INVENTION

1. Field of the Invention

The present invention relates to a central lock for multi-point safety belts or safety harnesses. The central lock includes a housing with several insertion openings distributed over the circumference of the housing. Tongues connected to the belts can be inserted into the insertion openings. A holding plate for holding bolts interacting with the tongues is fixed in the housing. A rotatable release member mounted outside of the housing is provided for axially displacing a release plate against the force of a restoring spring. A mechanism is arranged between the release member and the release plate for transforming the rotary movement of the release member into an axial displacement of the release plate.

2. Description of the Related Art

Safety belts which include a lap belt and additional shoulder belts as well as crotch belts, also called four-point, five-point or six-point belts, are usually equipped with so-called central locks. Such central locks have on the circumference thereof slot-like insertion openings in which the belts can be anchored by means of tongues attached to the belts. By actuating opening mechanisms, all or a certain number of the belts are released in such a way that the user of the harness can remove the belts without further impairment. The opening mechanisms are actuated by means of wing-like release members which are mounted in the center of the central locks. The release members can be rotated in both directions for actuating the opening mechanisms. Therefore, they are also called rotary locks. The tongues are anchored in the central locks by means of cylindrical holding bolts which engage under the load of a spring in bores of the tongues. Another possibility of anchoring is provided by rocker-type latches which engage in corresponding recesses in the tongues. In order to release the tongues, the holding bolts or the latches must be displaced axially by a predetermined dimension. For this purpose, the rotary movements of the wing-like release members are transformed into axial movements.

In accordance with a known embodiment, the principle of the inclined plane is utilized for transforming the rotary movements into axial movements. For this purpose, a spring-loaded release plate is arranged in the central lock. A projection in the shape of a tubular piece is arranged in the center axis of the release plate. The projection has four inclined planes arranged uniformly distributed over the circumference. Always two oppositely located inclined planes extend in opposite directions. Each plane forms a quarter helix. The release member is provided with a center axle which extends through the tubular projection of the release plate and which has at its end slide members which accurately correspond to the inclined planes. When the release member is rotated, the rotary movement is transformed into an axial movement as a result of the fact that the sliding members slide on the inclined planes. This results in a positively guided axial movement of the release plate.

In accordance with another embodiment, the sliding members are formed by a pin which transversely extends through the center axle of the release member and which slides with its end portions on the inclined planes.

The axial movement produced in this manner raises the release plate, so that the holding bolts are moved out of their holding positions and release the tongues.

Because of practical considerations, it is desirable to keep the structural height of such central locks low. The structural height of such locks is additionally limited by certain regulations, for example, the safety standards of racing cars FIA 8854 (Federation Internationale du Sport Automobile). In accordance with this regulation, the maximum diameter of the central lock is 71 mm.

For the above reasons, the diameter of the tubular central axles must be kept small in order to be able to accommodate the entire opening and anchoring mechanism for the tongues while taking into consideration the required cross-sections depending on the breaking load. However, the smaller this diameter is selected, the steeper the incline of the inclined planes must be in order to achieve the necessary axial displacement.

The angle of actuation of the rotary locks is usually a maximum of 90°. Some safety standards require additional free paths for the release member of at least 25° before activation of the opening mechanisms occurs. This means that there remain a maximum of 65° for the inclined planes for obtaining the desired axial displacements. While it can be simply assumed that, starting from a 45° inclination of the sides of the inclined planes, the force required for opening is equal to the axial force, this does not take into consideration the friction losses between the sliding blocks or pins and the sides of the planes.

In the embodiment utilizing a pin and inclined planes, only a linear contact exists between the two structural components which leads to the problem that the frictional losses are significantly increased as soon as any sliding/lubricating agent has been used up, has become resin, has been washed out under unfavorable environmental influences or has been contaminated as a result of the influence of dust and, thus, acts more like a grinding agent. This means that after the lock has been in use for several years, wear may occur which impairs the operation of the lock. Damage to the sliding surfaces leads to increased corrosion and abrasion and the attendant increase of frictional forces. This increase causes a direct linear increase of the force required for opening.

The inclined planes of the known embodiments are inclined linearly, so that the opening forces are constant. However, the spring forces which close the opening mechanisms have at least a linearly increasing force characteristic, so that the required opening forces of the central locks increase continuously during opening as a result of the superposition of forces.

The safety standards to be applied when testing such central locks require, in order to prevent unintentional opening, a minimum opening force of a lock which has not been subjected to a load resulting from an accident. The maximum opening forces are limited in order to be able to open the central lock without problems after a load resulting from an accident. The required force limits are between $\geqq 10N$ and $\leqq 60N$.

SUMMARY OF THE INVENTION

Therefore, it is the primary object of the present invention to improve the construction and manner of operation of a central lock of the above-described type in such a way that the rotary force required for opening the release member is decreased, while the mechanism for transforming the rotary movement into an axial movement is structurally more advantageous.

In accordance with the present invention, the mechanism for transforming the rotating movement of the release member into an axial displacement of the release plate is formed by at least one tilting member arranged between the release member and the release plate which is located on the side of the holding plate facing away from the release member.

Accordingly, the mechanism between the release member and the release plate which is now located on the side of the holding plate facing away from the release member, is formed by at least one tilting member. In principle, it is conceivable that structural intermediate components are provided for the release member. Instead of the known helically shaped sliding surfaces, the lock according to the present invention utilizes tilting members for transforming the rotating movement for actuating the lock into the desired axial movement. In principle, each tilting member is a straight line with bearing ends. The tilting member is movably clamped at a defined angle between the release member and the release plate. When the wing-shaped release member is rotated relative to the release plate, the ends of each tilting member are moved one above the other in a circular path. Since the release plate is axially displaceable, the release plate is moved axially by the tilting member relatively away from the release member and takes along the holding bolt, so that the tongues of the belts are released.

It is advantageous in this connection that, corresponding to the circular path on which the ends of the tilting member move, the force diagram rotary force/axial force is permanently changed in favor of the force for the axial movement. This counteracts not only the increase of the spring characteristic but also an initially relatively high opening force. However, the opening force increases during the opening procedure, so that the central lock can be opened without problems even after a load caused, for example, by an accident.

In accordance with the basic concept of the present invention, it is in principle sufficient that the tilting members have two ends which rest in an articulated manner against the release plate, on the one hand, and against the release member, on the other hand. In particular, the tilting members may be straight rod-shaped tilting members.

In accordance with another advantageous feature of the present invention, the tilting members may be equipped with three or four ends. Since a straight tilting member can produce the required axial movement only in one direction, it is advantageous to construct the tilting members at least as isosceles triangles, so that they have three ends. Accordingly, two straight tilting member portions are arranged opposite each other at the same defined angle and produce the desired axial movement in both directions of rotation of the release member. It is useful to adapt the tilting members to the selected radius of the distance to the center axis of the lock. Triangular tilting members have a lateral side which has a length which is selected such that a radial sector of more than 90° is covered.

When tilting members with four ends are used, it is conceivable to construct them rectangular, rhombic or trapezoidal.

In accordance with another feature of the present invention, the ends of the tilting members may be disk-shaped or spherically shaped. The bearings in the release member, in any intermediate component and in the release plate are of complimentary configuration.

In accordance with a further development of the invention, the release member includes a support plate, wherein the tilting members rest against the support plate, on the one hand, and against the release plate, on the other hand. In this manner, the entire opening mechanism can be accommodated within the housing so as to be closed off to the outside. In addition, it is possible to exchange the release member without having to carry out an assembly operation on the mechanism itself.

In accordance with another feature, a pressure plate is mounted between the tilting members and the release plate. The pressure plate engages through predetermined openings of the support plate and transmits the axial movement of the tilting members to the release plate.

In accordance with another feature, receiving means adapted to the contours of the ends of the tilting members are provided on the side of the release member or the support plate facing the release plate and in the release plate or the pressure plate, wherein the ends of the tilting members engage in a positively engaging and/or frictionally engaging manner in the receiving means.

Another feature of the present invention provides that the receiving means are displaceable and are subjected to the restoring influence of elastic members. This feature provides the free path required of a rotatable release member before the locking action is released. When the release member is rotated, the receiving means can be displaced by a defined dimension either axially or radially relative to the elastic members. The elastic members usually are springs. However, other embodiments, such as, rubber dampers, liquid dampers or magnet dampers, are also conceivable. The displaceable receiving means are preferably mounted in the release member or in a support plate. It is useful to secure the receiving means in position by means of stops and/or guide members.

If axially displaceable receiving means are provided in the release member, the first portion of the tilting movement of the tilting member represents the free path of the release member. The free path represents the dimension from which the receiving means can no longer be moved farther. A further rotary movement of the release member results in the axial displacement of the release plate.

If radially displaceable receiving means are provided, the central lock is only opened when the receiving means are no longer further radially displaceable relative to the release member.

In order to ensure that the ends of the tilting members are lifted out of the receiving means when the release member is activated and slide back into the receiving means during the closing movement, the receiving means are provided with inclined surfaces to facilitate insertion.

In accordance with another advantageous feature, the tilting members are equipped with tilt limiting means. Accordingly, a limitation of the movement can be obtained with simple means. Depending on the type of use, the tilt limiting means can be constructed in such a way that the release member remains in a permanent open position or automatically drops back into the closing position when the release member is not actuated. Dropping back of the release member is effected by ensuring that the tilting member is prevented by the tilting limiting means from being rotated to its vertical position or dead center, so that there is always a radial force which causes return into the initial position.

If the tilt limiting means are constructed in such a way that the tilting members can move up to or pass the dead center, the central lock remains in a permanent open position until the release member is moved back.

The tilt limiting means are advantageously formed by stops on the tilting members. However, it is also conceivable that the release plate is provided with at least one limiting means for the release path.

The above-described features all concern a central lock having a rotatable release member. However, the present invention can also be realized if the rotatable release member is exchanged for an axially acting pressure release member, while all other structural components remain the same. In this connection, a lever mechanism can be used whose fixed pivot point is located near the upper ends of the tilting member. These upper ends of the tilting members are then at least indirectly supported in a lever arm constructed as a pressure member. The combination of a lever arm, whose point of attack carries out a radial movement about a stationary pivot through a transmission element of corresponding construction for moving the release plate, with a tilting member having three ends, provides the advantage that the transformation of the radial movement of the point of attack between lever arm and tilting member into a linear movement can be carried out virtually without losses, since the ends of the tilting members act comparable to a spherical connection and, thus, the friction, as it would occur on surfaces which slide on each other, is minimized.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

DETAILED DESCRIPTION OF THE PREFERRED EMBODIMENTS

Figure 1:
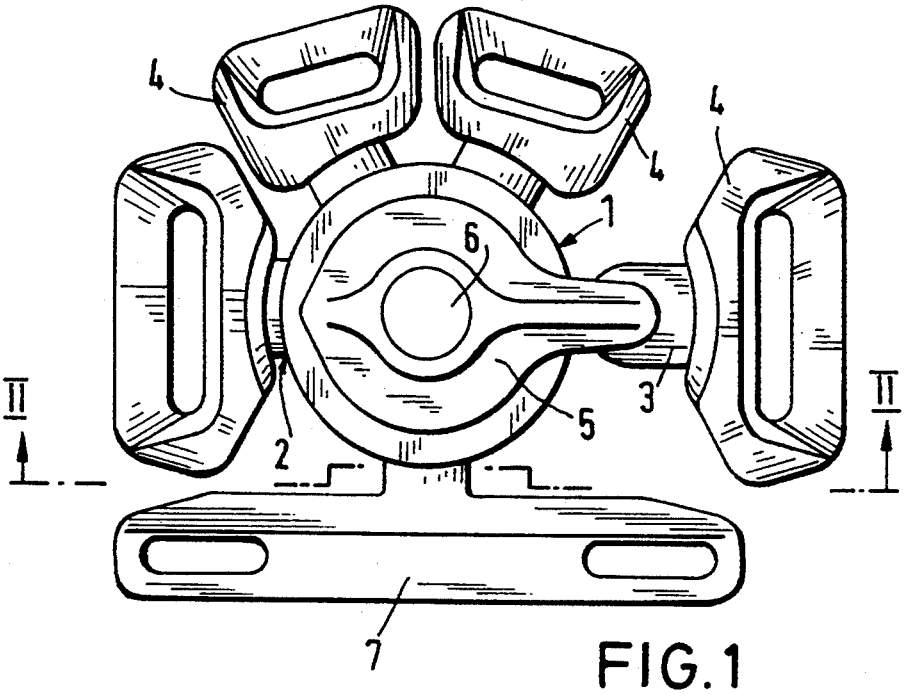
FIG. 1 is a schematic top view of a central lock for multi-point safety belts including the tongues of the belts.
Figure 2:
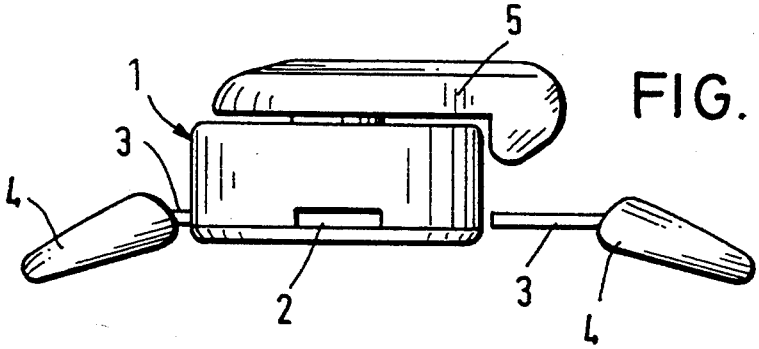
FIG. 2 is a schematic side view of the central lock of FIG. 1 as seen along line II—II.

FIGS. 1 and 2 of the drawing show a central lock for multi-point safety belts. The central lock includes a housing 1 with five insertion openings 2 which are distributed over the circumference of the housing 1. Tongues 3 which are connected to belts, not shown, are inserted into the insertion openings 2. The individual tongues 3 have connecting pieces 4 for the belts. For actuating the opening mechanism, a wing-like release member 5 is arranged on the upper side of the housing 1. The release member 5 engages into the opening mechanism through a center axle 6. FIG. 1 additionally shows a fitting member 7 of a base belt attached to the central lock.

Figure 4:
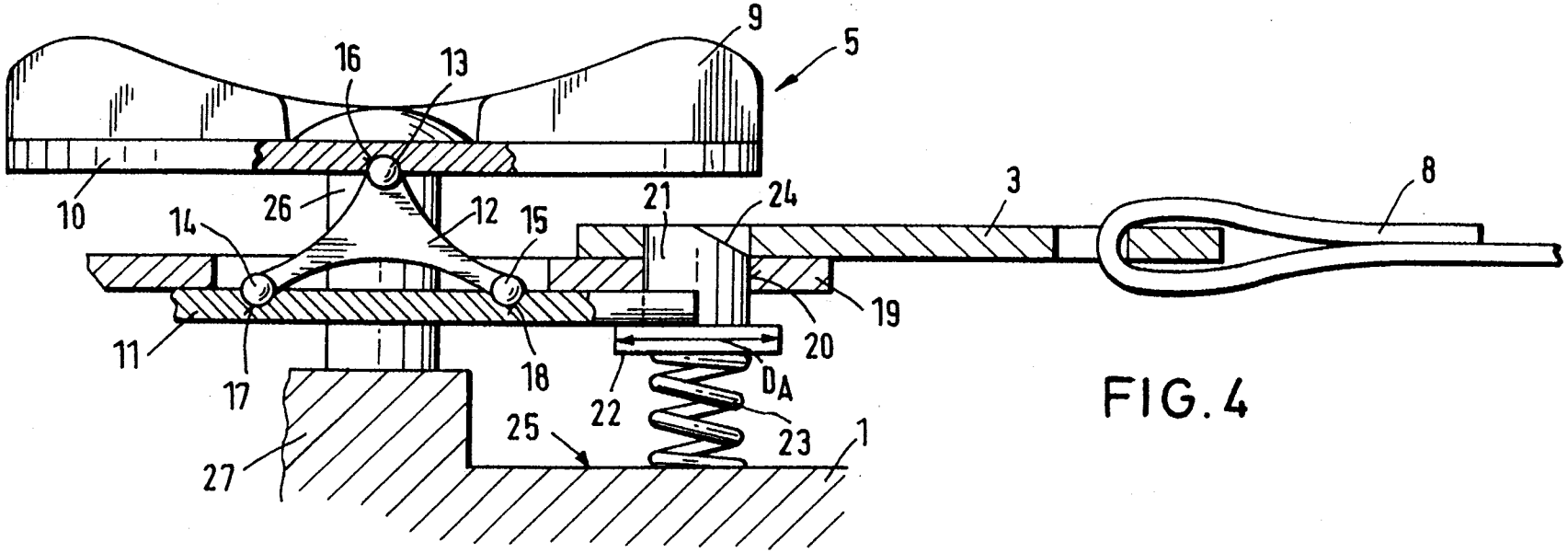
FIG. 4 is a schematic side view, partially in vertical section, of a portion of a central lock with a tilting member with three ends, shown in the closed position.

The tongues 3 are locked in the central lock by means of holding bolts 21, shown in FIG. 4. When the release member is actuated, it is rotated and transforms by means of the opening mechanism the rotary movement into an axial displacement of a release plate 11, also shown in FIG. 4. In this manner, the holding bolts 21 are guided out of the tongues and release the tongues.

Figure 3:
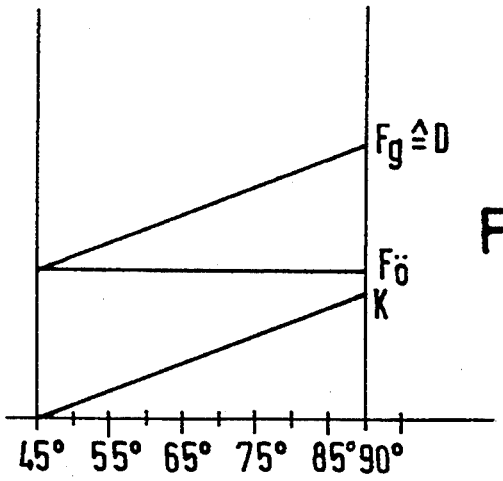
FIG. 3 is a diagram showing the force pattern over the opening angle.

The diagram of FIG. 3 shows the superposition of the opening force $F_o$ with the spring force K of a central lock which includes a mechanism which utilizes the principle of the inclined plane. The superposition of the opening force $F_o$ which is constant over the opening path and the linearly increasing spring force F means that the two forces are added resulting in a constant increasing total force Fg. The total force Fg corresponds to the rotary force D required for opening the central lock. As is clear from FIG. 3, the opening force $F_o$ constantly increases with increasing opening path.

FIG. 4 of the drawing is a side view, partially in vertical section, generally illustrating a portion of a central lock. As shown in FIG. 4, a belt 8 is connected to the tongue 3. The release member 5 has a grip 9 with a base plate 10. A tilting member 12 is mounted between the base plate 10 and the release plate 11. The tilting member 12 has three ends 13, 14, 15. The ends 13, 14, 15 are spherically shaped, wherein the end 13 engages in a frictionally engaging manner in a corresponding hemispherical receiving recess 16 in the base plate 10 and the ends 14 and 15 engage in corresponding receiving recesses 17 and 18, respectively, in the release plate 11.

FIG. 4 of the drawing additionally shows a portion of the housing 1. A holding plate 19 is fixedly mounted within the housing 1. A holding bolt 21 is axially displaceably mounted in a bore 20 of the holding plate 19. Depending on the number of belts 8, the corresponding number of insertion openings 2, shown in FIG. 1, and holding bolts 21 are mounted in the housing 1.

The holding bolt 21 includes a disk-shaped stop member 22 and is acted on by a compression spring 23. An inclined surface 24 ensures that the holding bolt 21 is pressed downwardly against the force of the compression spring 23 when the tongue 3 is inserted into the central lock. The length of the holding bolt 21 is dimensioned in such a way that it corresponds to the combined thickness of the release plate 11, the holding plate 19 and the tongue 3. The diameter $D_A$ of the stop member 22 is greater than the diameter of the bore 20, so that the stop member 22 forms the upward limit of the axial movement of the holding bolt 21 as seen in the plane of the drawing.

When the release plate 11 is axially moved downwardly by the holding plate 19, the release plate 11 also moves down the holding bolt 21. A compression spring 23 rests with its end facing away from the holding bolt 21 against an only schematically illustrated lock bottom 25 of the housing 1. In the closed position of the central lock, the holding bolt 21 and the release plate 11 are pressed against the holding plate 19 by the compression spring 23. The release member 5 is connected through a central axis 26 to a projection 27 of the lock bottom 25. The holding plate 19 and the lock bottom 25 are secured against relative rotation. The release plate 11 is secured against rotation since it engages the holding bolt 21 and the central axis 26.

Figure 5:
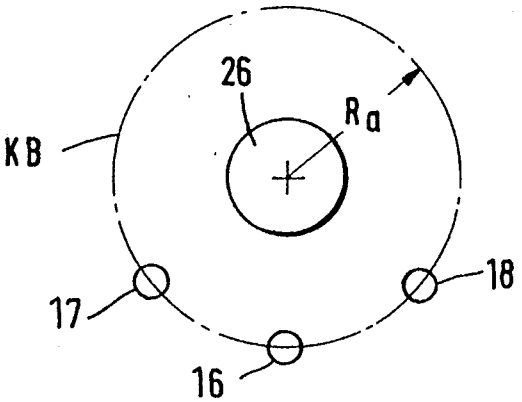
FIG. 5 is a schematic top view of the arrangement of the ends of the tilting member of FIG. 4.

FIG. 5 of the drawing shows the arrangement of the hemispherical receiving recesses 16, 17 and 18 on a circular path KB having a predeterminable radius $R_a$ about the vertical center axle 26 of the lock shown in FIG. 4.

The curvature of the tilting member 12 is selected corresponding to the arrangement of the receiving recesses 16, 17, 18 on the circular path KB of the radius $R_a$ about the center axle 26. In the closed position of the central lock, all spherically shaped ends 13, 14, 15 are located in the receiving recesses 16, 17, and 18.

Figure 6:
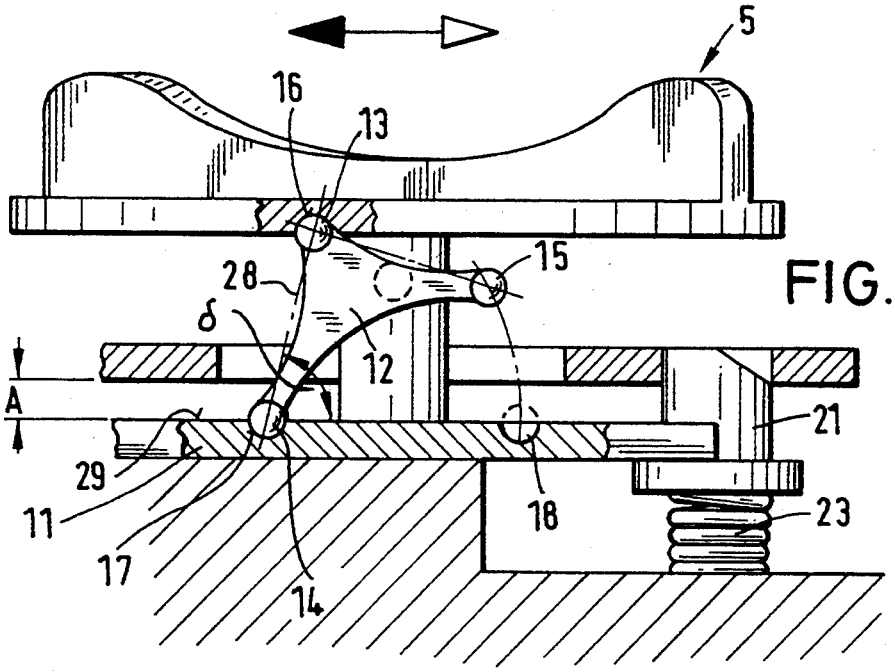
FIG. 6 is the side view of FIG. 4, showing the central lock in the open position.

When the release member 5 is rotated relative to the release plate 11, as shown in FIG. 6, the end 13 is displaced together with the release member 5 in accordance with the circular movement of the release member 5. The end 13 rolls during this movement within the receiving recess 16. The end 14 rotates at the same time in the receiving recess 17 of the release plate 11. The side 28 of the tilting member 12 represented by a straight line extending through the ends 13 and 14 is then moved upwardly into an essentially vertical position, i.e., the angle $\delta$ between the side 28 and the upper side 29 of the release plate 11 is increased. As a result, the tilting movement of the tilting member 12 is transformed into a downward axial movement of the release plate 11 as seen in the plane of the drawing. In this manner, the release plate 11 is moved downwardly relative to the stationary release member 5 by the release path A.

During the movement of the tilting member 12, the end 15 is lifted out of the receiving recess 18. The release plate 11 is moved against the force of the compression spring 23 and takes with it the support bolt 21 in a downward movement, so that the tongue of the belt, not shown in FIG. 6, is released.

Figure 7:
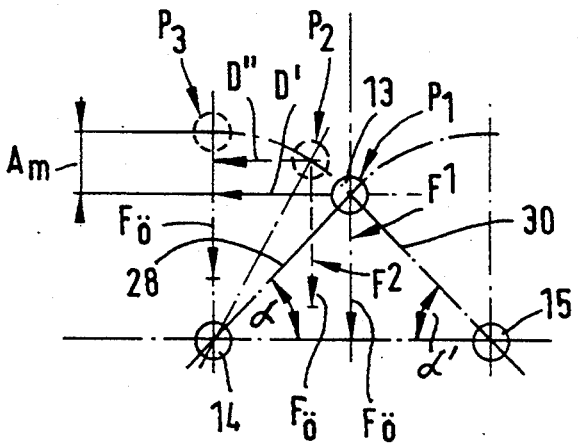
FIG. 7 is a schematic side view illustrating the sequence of movement of a tilting member with three ends.

FIG. 7 of the drawing schematically shows the circular arc-shaped path of movement of the end 13 relative to the radially stationary end 14 in three positions $P_1$, $P_2$, $P_3$. Depending on the angle $\alpha$ or $\alpha'$ in the position of rest and the length of the side 28 between the ends 13 and 14 or the length of the side 30 between the ends 13 and 15, a displacement dimension $A_m$ is computed, wherein the displacement dimension $A_m$ corresponds to the release path A. FIG. 7 also shows the force diagrams $F^1$, $F^2$. The diagrams show the opening force $F_o$ and the rotary force D in the various positions. The diagrams show that with increasing tilting movement of the end 13 in the direction above the end 14, the required rotary force D', D'' significantly decreases while the opening force $F_o$ remains the same and, in the essentially vertical position of the ends 13 and 14, the required rotary force approaches zero.

Figure 8:
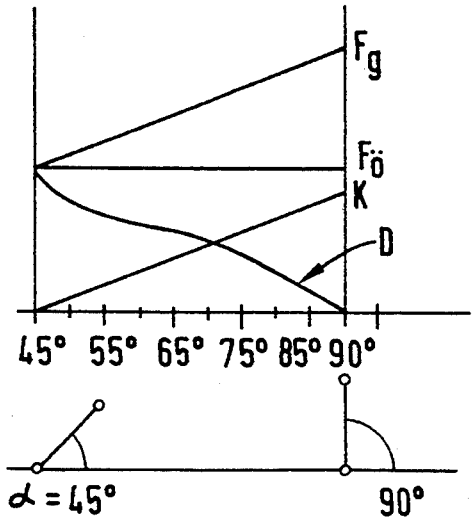
FIG. 8 is a diagram showing the force pattern over the opening angle of a central lock with tilting members.

The relationship described above is illustrated in FIG. 8 in the form of a diagram showing the force pattern over the opening angle. Starting from an angle $\alpha$ of 45° in the position of rest, the rotary force D decreases over the path of rotation, wherein the opening force $F_o$ and the spring force K are again superimposed to form a constantly increasing total force $F_g$.

Figure 9:
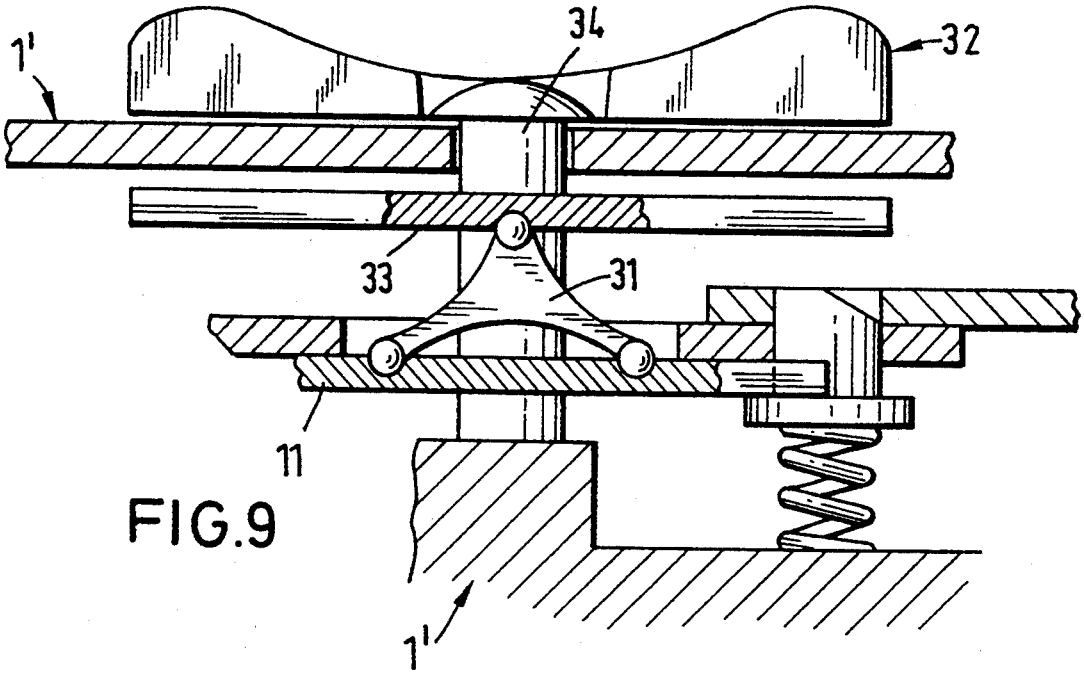
FIG. 9 is a side view, partially in vertical section, showing a portion of a central lock with a support plate provided for the release member.

FIG. 9 of the drawing shows an embodiment of the central lock according to the present invention in which a tilting member 31 rests against a support plate 33 provided for the release member 32 and the release plate 11. The release member 32 is arranged outside of a schematically illustrated housing 1'. The support plate 33 and the release member 32 are fixedly connected through a central axle 34.

Figure 10:
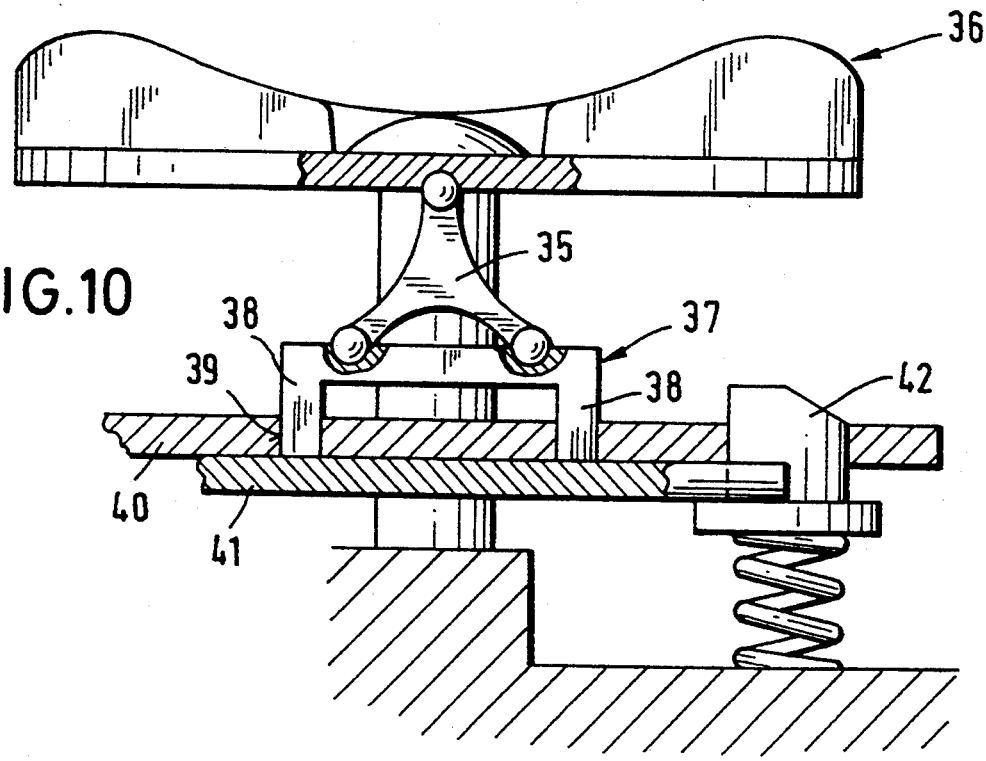
FIG. 10 is a side view, partially in vertical section, showing a portion of a central lock with a pressure plate provided for the release plate.

FIG. 10 of the drawing shows an embodiment of the central lock according to the present invention in which a tilting member 35 is supported between a release member 36 and a pressure plate 37. The pressure plate 37 has projections 38 which extend through openings 39 of the holding plate 40 and act on the release plate 41. The rotating movement of the release member 36 is transformed through the tilting member 35 into an axial displacement of the pressure plate 37 which, in turn, moves the release plate 41 downwardly. The holding bolt 42 is moved downwardly together with the release plate 41.

Figure 11:
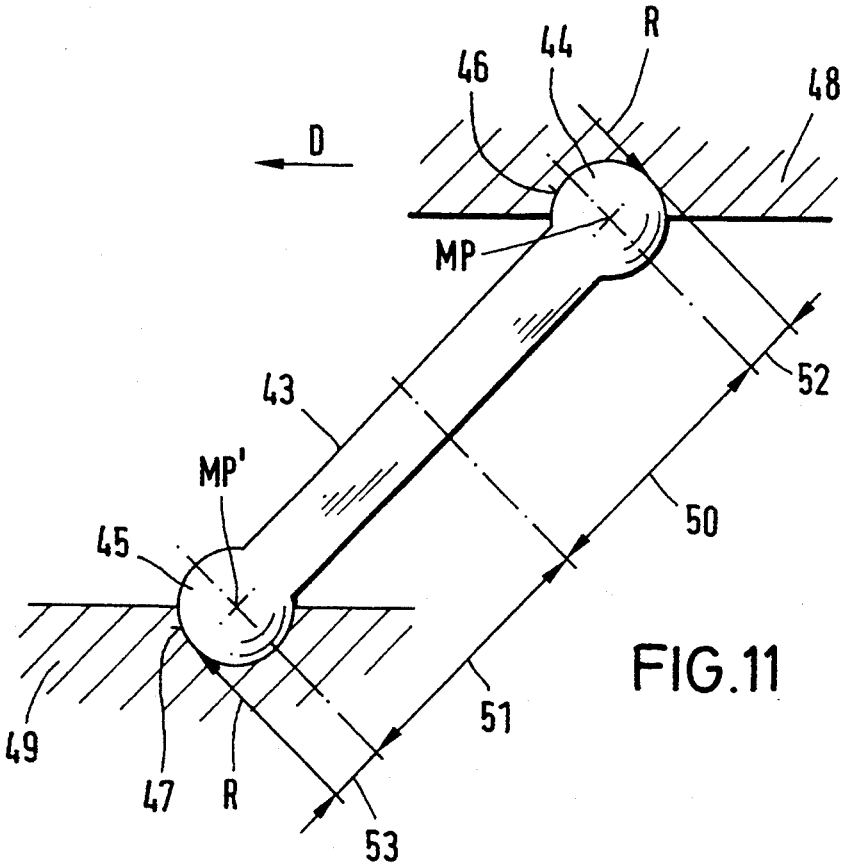
FIG. 11 is a side view of a tilting member with two ends.

FIG. 11 shows a tilting member 43 which is rod-shaped and has spherically shaped ends 44, 45. The ends 44, 45 are supported in receiving recesses 46, 47 of a support plate 48 or release plate 49, wherein the receiving recesses 46, 47 are adapted to the contours of the ends 44, 45. The illustration of FIG. 11 makes it possible to explain the influence of possible corrosion between the ends 44, 45 and the receiving recesses 46, 47 on an increase of the rotary force.

The distance between the two ends 44, 45 is divided into two lever arms 50, 51 of equal length. The lever arms 50, 51 are opposed by the lever arms 52, 53 from the point of attack of a resulting friction force R on the outer circumference of the spherically shaped ends 44 and 45, relative to the center points MP, MP' of the ends 44, 45. Since the length of the lever arms 50, 51 is a multiple of the length of the lever arms 37, 38, the influence of the frictional forces on an increase of the rotary force is significantly decreased.

Figure 12:
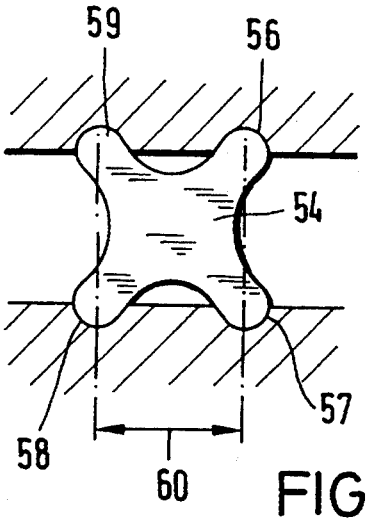
FIG. 12 is a side view of a tilting member with four ends.
Figure 13:
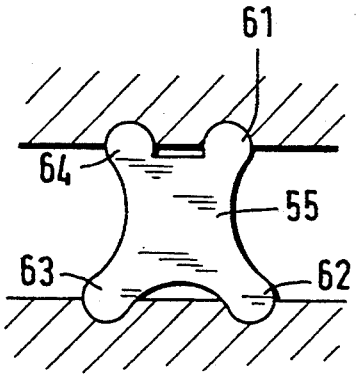
FIG. 13 is a side view of another tilting member with four ends.

FIGS. 12 and 13 of the drawing show additional geometric configurations of tilting members 54 and 55, respectively. The tilting member 54 has four ends 56 to 59 and the sides thereof have a square configuration. This configuration of the ends 56 to 59 has the result that a base line 60 can have half the length of a base side of a triangular configuration of the tilting member. Since a tilting member must be shaped in accordance with the respectively selected radius $R_a$, compare FIG. 5, there is the advantage in this case that the ends 57 and 59 which are released during a rotation, for example, in a clockwise direction, are deflected to a smaller extent toward the radius $R_a$.

If the required release dimension is, for example, 3 mm and starting from an angle $\alpha$, $\alpha'$ in the position of rest of 45°, the base line is computed to about 8 mm. Translated into the circular arc portion of a radius $R_a$ of 16 mm, this portion is about 57° between the ends 57 and 58. In the case of a triangular tilting member and using the same computation, a circular arc portion of 114° would result between the corresponding ends.

The tilting member 55 illustrated in FIG. 13 is trapezoidally shaped and also has four ends 61 to 64.

Figure 14:
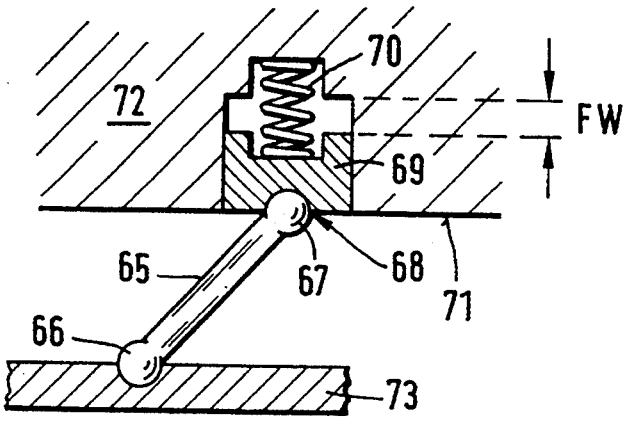
FIG. 14 is a schematic view, partially in section, of a tilting member with two ends and an axially displaceable receiving means, shown in the closed position.
Figure 15:
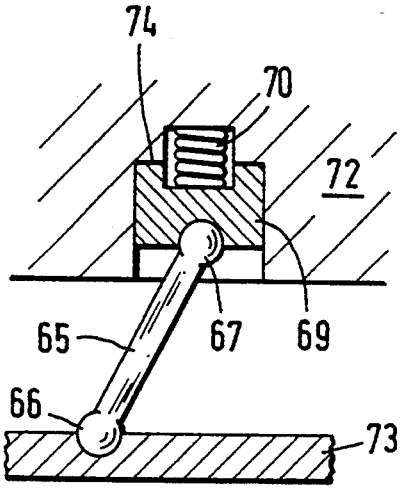
FIG. 15 is a schematic view, partially in section, of a tilting member with two ends and an axially displaceable receiving means, shown after the free path has been traveled.

FIGS. 14 and 15 show a rod-shaped tilting member 65 with two ends 66, 67 and an axially displaceable receiving recess 68. FIG. 14 shows the closed position, while FIG. 15 shows the position of the release member after the free path has been traveled.

The receiving recess 68 is arranged in a receiving block 69 which is displaceable against the force of a compression spring 70. This configuration results in a free path FW before which the opening mechanism operates. In the closed position, the receiving block 69 is pressed down by the compression spring 70 and ends flush with the underside 71 of the support disk 72. When the release member is actuated, the support disk 72 is rotated radially relative to the release plate 73. As a result, the tilting member 65 is initially moved toward an upright position until the receiving block 69 has been moved against the force of the spring 70 to a stop 74 without actuating the release plate 73. The rotary movement carried out by the release member up to now corresponds to the desired free path FW. The rotary movement of the release member is transformed into an axial displacement of the release plate 73 only after the receiving block 69 has reached the stop 74.

Figure 16:
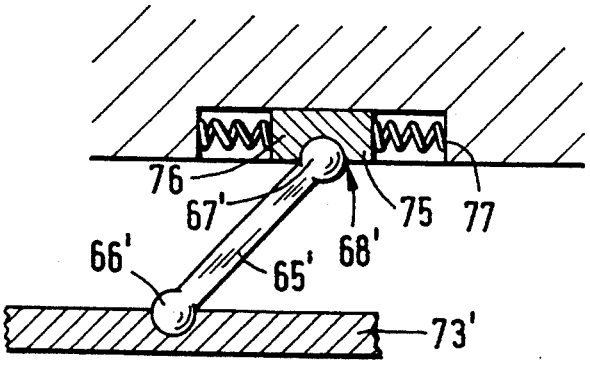
FIG. 16 is a schematic view, partially in section, of a tilting member with two ends and a radially displaceable receiving means.

FIG. 16 of the drawing shows an opening mechanism in which a tilting member 65' with two ends 66', 67' and a receiving recess 68' is arranged in a radially displaceable receiving block 75. Compression springs 76, 77 act on the receiving block 75. When a release member, not shown, is rotated toward the left as seen in the plane of the drawing relative to the release plate 73', initially the receiving block 75 is moved until the compression spring 77 is pushed together into its end position. The path traveled up to this limit again produces the desired free path. The rotary movement of the release member is transformed into the axial movement of the release plate 73' only after this free path has been traveled.

Figure 17:
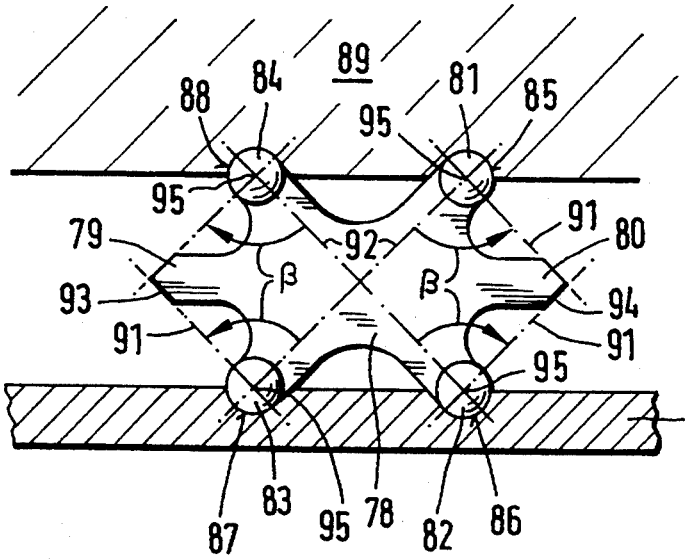
FIG. 17 is a schematic view, partially in section, of a tilting member with four ends and tilt limiting means, shown in the closed position.
Figure 18:
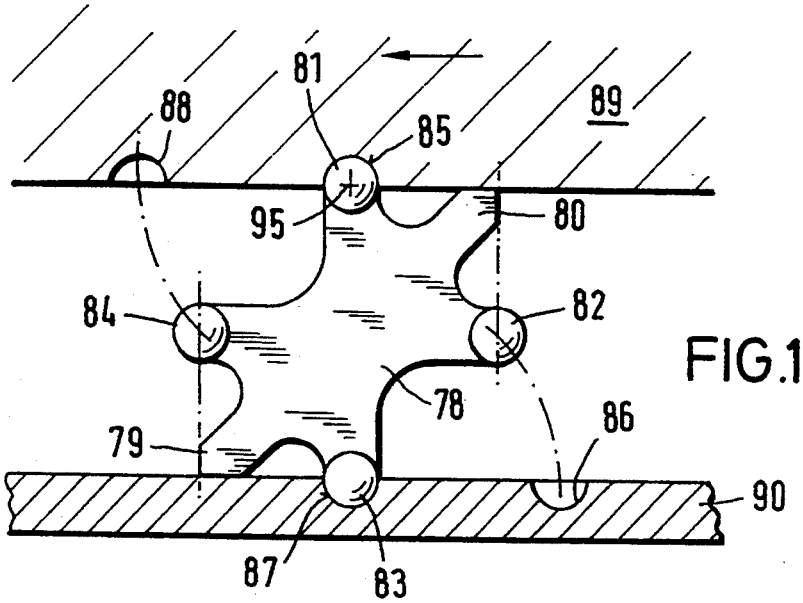
FIG. 18 is a schematic view, partially in section, of a tilting member with four ends and tilt limiting means, shown in the open position.

FIGS. 17 and 18 show a tilting member 78 which is equipped with tilt limiting members 79, 80. The tilting member 78 again has four ends 81–84 for which correspondingly formed recesses 85–88 are arranged in a support plate 89 and a release plate 90, respectively.

The wing-shaped tilt limiting members 79, 80 are constructed in such a way that they make contact with the release plate 90 or the support plate 89 in the maximum desired tilting position, as shown in FIG. 18. As a result, any further rotary movement of the support plate 89 and a release member is prevented. By selecting the tilting angle $\beta$, which is formed by the lines 91 and 92, it is possible to predetermine whether a permanent open position of the closing mechanism or an automatic return movement are carried out. The lines 91 are tangents to the sides 93 and 94 of the tilt limiting members 79, 80, respectively, and extend through points of rotation 95 of the ends 81 to 84. The lines 92 are formed by the diagonals of the tilting member 78.

Figure 19:
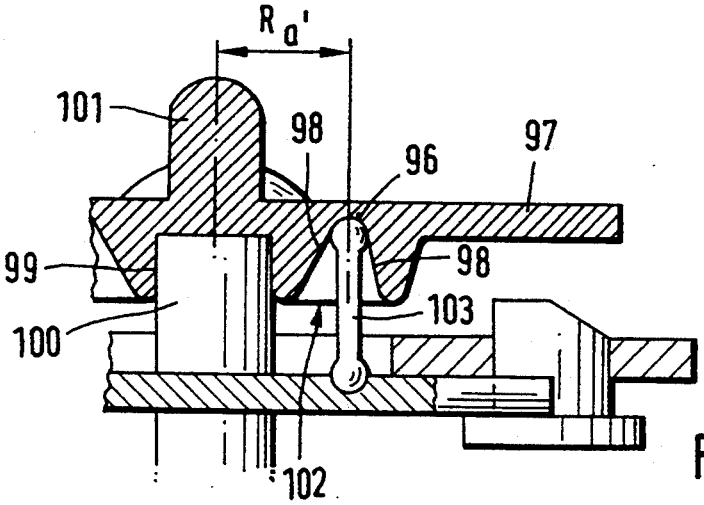
FIG. 19 is a side view, partially in vertical section, of a portion of a central lock with receiving means having inclined insertion surfaces.

FIG. 19 of the drawing shows the possibility of providing a receiving recess 96 in a support plate 97 with inclined insertion surfaces 98. The support plate 97 has a central bushing 99 for receiving a center axle 100. For coupling to a release member, the support plate 97 has a projection 101.

The support plate 97 has a circumferential conical recess 101 around the center axle 100 at a distance corresponding to radius $R_{a'}$. The conical recess 102 forms the inclined insertion surfaces 98. Since the tilting member 103 shown in FIG. 19 is bent corresponding to the selected radius $R_{a'}$ to conform with the center axle 100, the free ends which are released depending on the tilting direction are pivoted out of their radial positions. Accordingly, the inclined insertion surfaces 98 are inclined in accordance with this pivoting movement.

The invention is not limited by the embodiments described above which are presented as examples only but can be modified in various ways within the scope of protection defined by the appended patent claims.

I claim:

1. A central lock for multi-point safety belts, the central lock comprising a housing having an axis and a circumference, the housing defining a plurality of insertion openings distributed over the circumference of the housing, tongues connected to safety belts being adapted for insertion into the insertion openings, a holding plate fixedly mounted in the housing, a release plate mounted in the housing on a side of the holding plate facing away from the release member so as to be axially displaceable away from the holding plate, holding bolts axially movably mounted in the holding plate for engagement with the tongues, a rotatable release member mounted outside of the housing for axially displacing the release plate and the holding bolts against a force of a restoring spring, a mechanism arranged between the release member and the release plate for transforming a rotary movement of the release member into an axial displacement of the release plate, the mechanism comprising at least one tilting member arranged between and in engagement with the release member and the release plate.

2. The central lock according to claim 1, wherein the at least one tilting member comprises at least two ends, one of the ends resting in an articulated manner against the release plate and the other of the ends resting in an articulated manner against the release member.

3. The central lock according to claim 2, wherein the at least one tilting member comprises three ends.

4. The central lock according to claim 2, wherein the at least one tilting member comprises four ends.

5. The central lock according to claim 2, wherein the ends are disk-shaped.

6. The central lock according to claim 2, wherein the ends are spherically shaped.

7. The central lock according to claim 2, comprising a support plate mounted in the housing and connected to the release member, the at least one tilting member being arranged between the release member and the support plate.

8. The central lock according to claim 7, wherein the support plate and the release plate comprise receiving means, the receiving means and the ends of the at least one tilting member having corresponding contours for one of positive and frictional engagement therebetween.

9. The central lock according to claim 8, wherein the receiving means are diplaceable, further comprising elastic members for applying a restoring force against the receiving means.

10. The central lock according to claim 8, wherein the receiving means are axially diplaceable.

11. The central lock according to claim 8, wherein the receiving means are radially diplaceable.

12. The central lock according to claim 8, wherein the receiving means comprise inclined insertion surfaces.

13. The central lock according to claim 2, comprising a pressure plate mounted in the housing and connected to the release plate, the at least one tilting member being arranged between the release member and the pressure plate.

14. The central lock according to claim 13, wherein the pressure plate and the release member comprise receiving means, the receiving means and the ends of the at least one tilting member having corresponding contours for one of positive and frictional engagement therebetween.

15. The central lock according to claim 14, wherein the receiving means are diplaceable, further comprising elastic members for applying a restoring force against the receiving means.

16. The central lock according to claim 14, wherein the receiving means are axially diplaceable.

17. The central lock according to claim 14, wherein the receiving means are radially diplaceable.

18. The central lock according to claim 14, wherein the receiving means comprise inclined insertion surfaces.

19. The central lock according to claim 2, wherein the release member and the release plate comprise receiving means, the receiving means and the ends of the at least one tilting member having corresponding contours for one of positive and frictional engagement therebetween.

20. The central lock according to claim 19, wherein the receiving means are diplaceable, further comprising elastic members for applying a restoring force against the receiving means.

21. The central lock according to claim 19, wherein the receiving means are axially diplaceable.

22. The central lock according to claim 19, wherein the receiving means are radially diplaceable.

23. The central lock according to claim 19, wherein the receiving means comprise inclined insertion surfaces.

24. The central lock according to claim 1, wherein the at least one tilting member comprises means for limiting a tilting movement of the tilting member.

25. A central lock for multi-point safety belts, the central lock comprising a housing having an axis and a circumference, the housing defining a plurality of insertion openings distributed over the circumference of the housing, tongues connected to safety belts being adapted for insertion into the insertion openings, a holding plate fixedly mounted in the housing, a release plate mounted in the housing on a side of the holding plate facing away from the release member so as to be axially displaceable away from the holding plate, holding bolts axially movably mounted in the holding plate for engagement with the tongues, a rotatable release member which is rotatable about an axis being mounted outside of the housing for axially displacing the release plate and the holding bolts against a force of a restoring spring, a mechanism arranged between the release member and the release plate for transforming a rotary movement of the release member into an axial displacement of the release plate, the mechanism comprising at least one tilting member arranged between and in engagement with the release member and the release plate, wherein the tilting member is tiltable about an axis, and wherein the axis of the tilting member extends perpendicularly to the axis of the release member.

* * * * *